US007329131B1

(12) United States Patent
Chen

(10) Patent No.: US 7,329,131 B1
(45) Date of Patent: Feb. 12, 2008

(54) ELECTRICAL TRACK AND CONNECTOR ASSEMBLY

(76) Inventor: Chi-Wen Chen, No. 105, Alley 27, Lane 143, Chun-King Road, Taipei City (TW)

( * ) Notice: Subject to any disclaimer, the term of this patent is extended or adjusted under 35 U.S.C. 154(b) by 0 days.

(21) Appl. No.: 11/675,536

(22) Filed: Feb. 15, 2007

(30) Foreign Application Priority Data

Sep. 29, 2006 (CN) ..... 200620136924

(51) Int. Cl.
*H01R 4/66* (2006.01)

(52) U.S. Cl. ..... 439/94

(58) Field of Classification Search ..... 439/94, 439/118, 209, 115, 148, 579, 723, 34, 532, 439/716; 174/57
See application file for complete search history.

(56) References Cited

U.S. PATENT DOCUMENTS 3,081,442 A 3/1963 Platz
4,875,871 A 10/1989 Booty, Sr. et al.
5,404,279 A 4/1995 Wood
5,810,618 A * 9/1998 Barbier et al. ..... 439/532
6,429,379 B1 8/2002 Yoshigi
6,780,020 B2 * 8/2004 Kondo et al. ..... 439/34
7,011,545 B2 * 3/2006 Brandt et al. ..... 439/579
7,094,077 B1 * 8/2006 Chen ..... 439/118
2006/0211300 A1 9/2006 Kubota et al.

* cited by examiner

*Primary Examiner*—J. F. Duverne
(74) *Attorney, Agent, or Firm*—Schwabe, Williamson & Wyatt, P.C.

(57) ABSTRACT

An electrical track and connector assembly includes at least two electrical tracks each having two spaced-apart track wires, and an electrical connector having a housing, and first and second conductive wire units disposed in the housing. The housing has two connecting end portions connected respectively to the electrical tracks, and a wire prop-up unit projecting from an inner surface thereof. Each of the first and second conductive wire units includes two terminals respectively disposed in the connecting end portions and connected electrically and respectively to the track wires, and an intermediate portion interconnecting the terminals. The intermediate portion of one of the first and second conductive wire units has at least one bent rising section held by the wire prop-up unit and extending across the intermediate portion of the other one of the first and second conductive wire units without contact therewith.

10 Claims, 12 Drawing Sheets

ELECTRICAL TRACK AND CONNECTOR ASSEMBLY

CROSS-REFERENCE TO RELATED APPLICATION

This application claims priority of Chinese Application No. 200620136924.5, filed on Sep. 29, 2006.

BACKGROUND OF THE INVENTION

1. Field of the Invention

The invention relates to an electrical track and connector assembly, more particularly to an electrical track and connector assembly used in an electric distributing system for interconnecting two or more electrical tracks.

2. Description of the Related Art

Conventionally, an electrical receptacle is fixed directly to a wall, furniture, or the ground to permit insertion of an electrical plug of an electrical appliance therein. Since the electrical receptacle is fixed, when the electrical appliance is moved, and the length of its electrical wire is short, use of the electrical receptacle is very inconvenient. To resolve this drawback, an electric distributing system having a movable electrical receptacle was developed. The electric distributing system employs a plurality of electrical connectors to interconnect a plurality of electrical tracks. An electrical receptacle is slidable along each track so that the electrical receptacle can be disposed in a position as required, thereby providing increased convenience in the electrical connection of electrical appliances.

The electrical connector that interconnects two adjacent electrical tracks, generally, has three conductive wire units so as to connect electrically and respectively the hot, neutral, and ground lines of the two adjacent electrical tracks. However, such interconnection sometimes results in overlapping or intersecting of the conductive wire units. This is particularly the case with an electrical connector having three or more connecting end portions. The overlapping or intersecting of the conductive wire units not only may result in difficult connection of the wires, but also in easy contact of the conductive wire units which may be dangerous, especially after long term use.

SUMMARY OF THE INVENTION

Therefore, the object of the present invention is to provide an electrical track and connector assembly for an electric distributing system that is safe to use and that is easy to assemble.

According to one aspect of this invention, an electrical track and connector assembly comprises at least two electrical tracks and an electrical connector.

Each of the electrical tracks includes first and second track wires spaced apart from each other. The electrical connector includes a housing, and first and second conductive wire units disposed in the housing. The housing has at least two connecting end portions connected respectively to the electrical tracks, and a wire prop-up unit projecting from an inner surface of the housing. The first conductive wire unit includes at least two first terminals respectively disposed in the connecting end portions and connected electrically and respectively to the first track wires of the electrical tracks, and a first intermediate portion interconnecting the first terminals. The second conductive wire unit includes at least two second terminals respectively disposed in the connecting end portions and connected electrically and respectively to the second track wires of the electrical tracks, and a second intermediate portion interconnecting the second terminals. At least one of the first and second intermediate portions has at least one first bent rising section held by the wire prop-up unit and extending across the other one of the first and second intermediate portions without contact therewith.

According to another aspect of this invention, an electrical track and connector assembly comprises at least two electrical tracks and an electrical connector. Each of the electrical tracks includes first and second track wires spaced apart from each other. The electrical connector includes a housing, and first and second conductive wire units disposed in the housing. The housing has at least two connecting end portions connected respectively to the electrical tracks, and a wire prop-up unit that includes a block projecting from an inner surface of the housing. The first conductive wire unit includes at least two first terminals respectively disposed in the connecting end portions and connected electrically and respectively to the first track wires of the electrical tracks, and a first intermediate portion interconnecting the first terminals. The second conductive wire unit includes at least two second terminals respectively disposed in the connecting end portions and connected electrically and respectively to the second track wires of the electrical tracks, and a second intermediate portion interconnecting the second terminals. At least one of the first and second intermediate portions has at least one bent rising section held by the wire prop-up unit. The block has an indentation disposed away from the inner surface of the housing to retain therein the bent rising section of the second intermediate portion.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
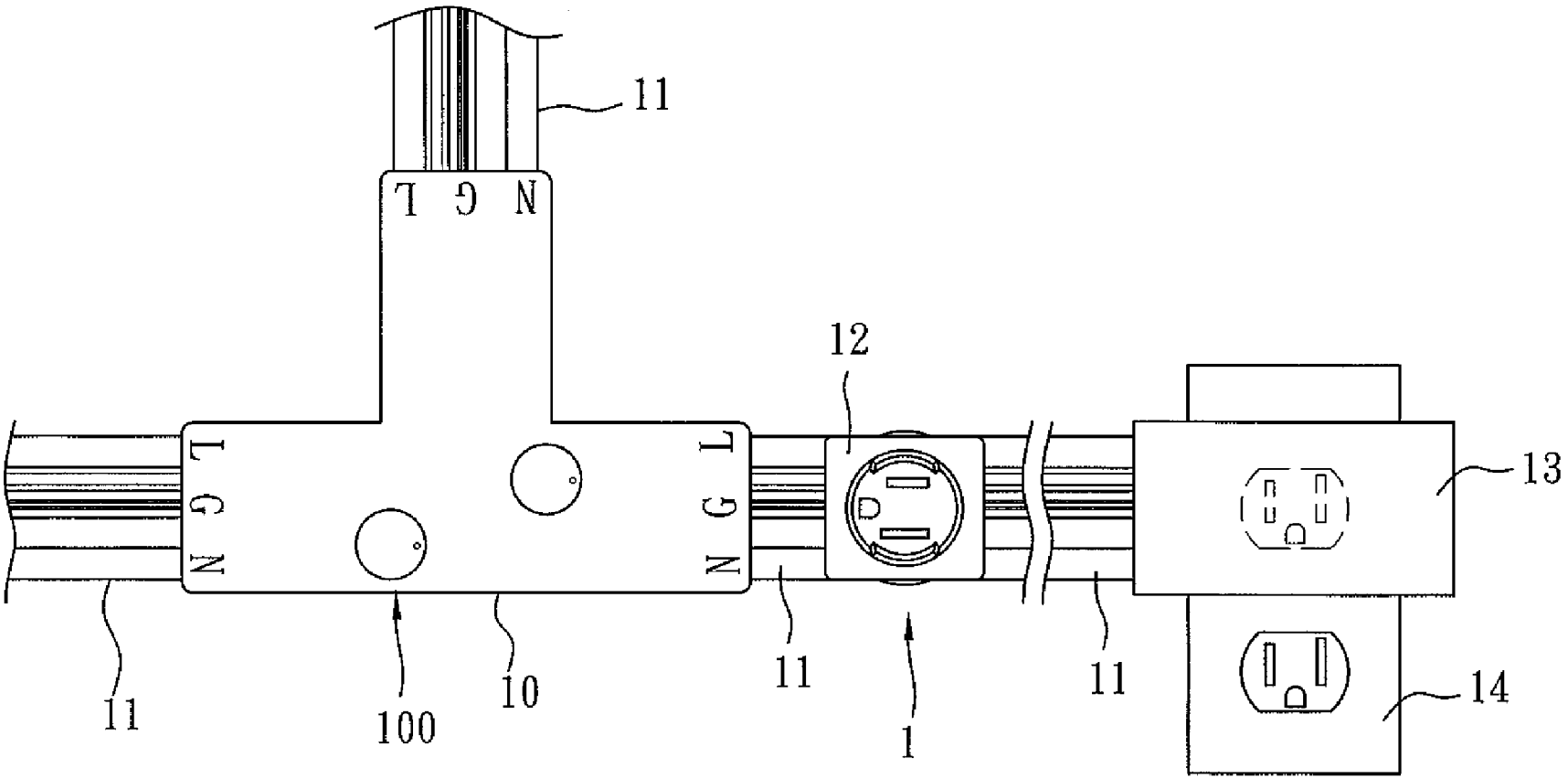
FIG. 1 is a fragmentary schematic view of an electric distributing system that incorporates the first preferred embodiment of an electrical track and connector assembly of the present invention.
Figure 2:
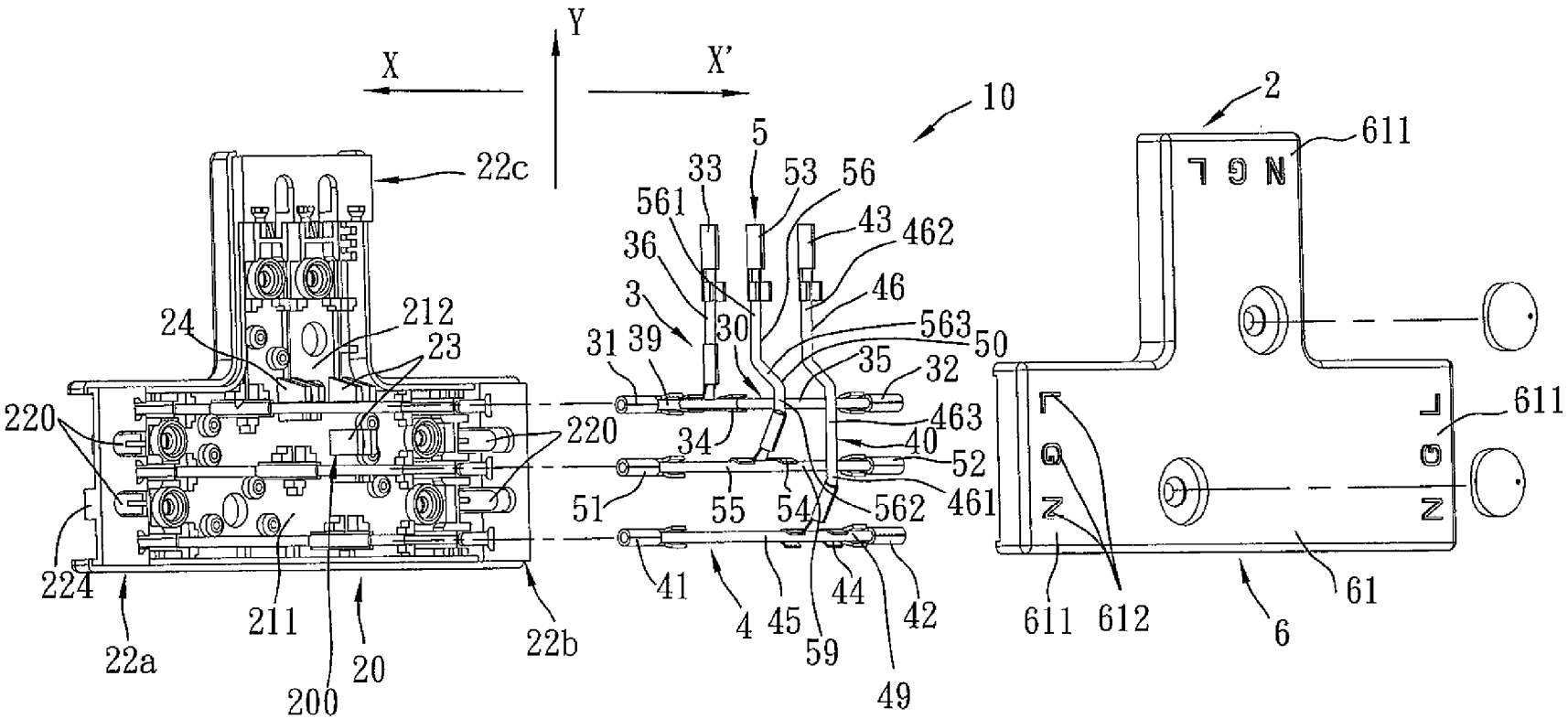
FIG. 2 is an exploded perspective view of an electrical connector of the first preferred embodiment.
Figure 3:
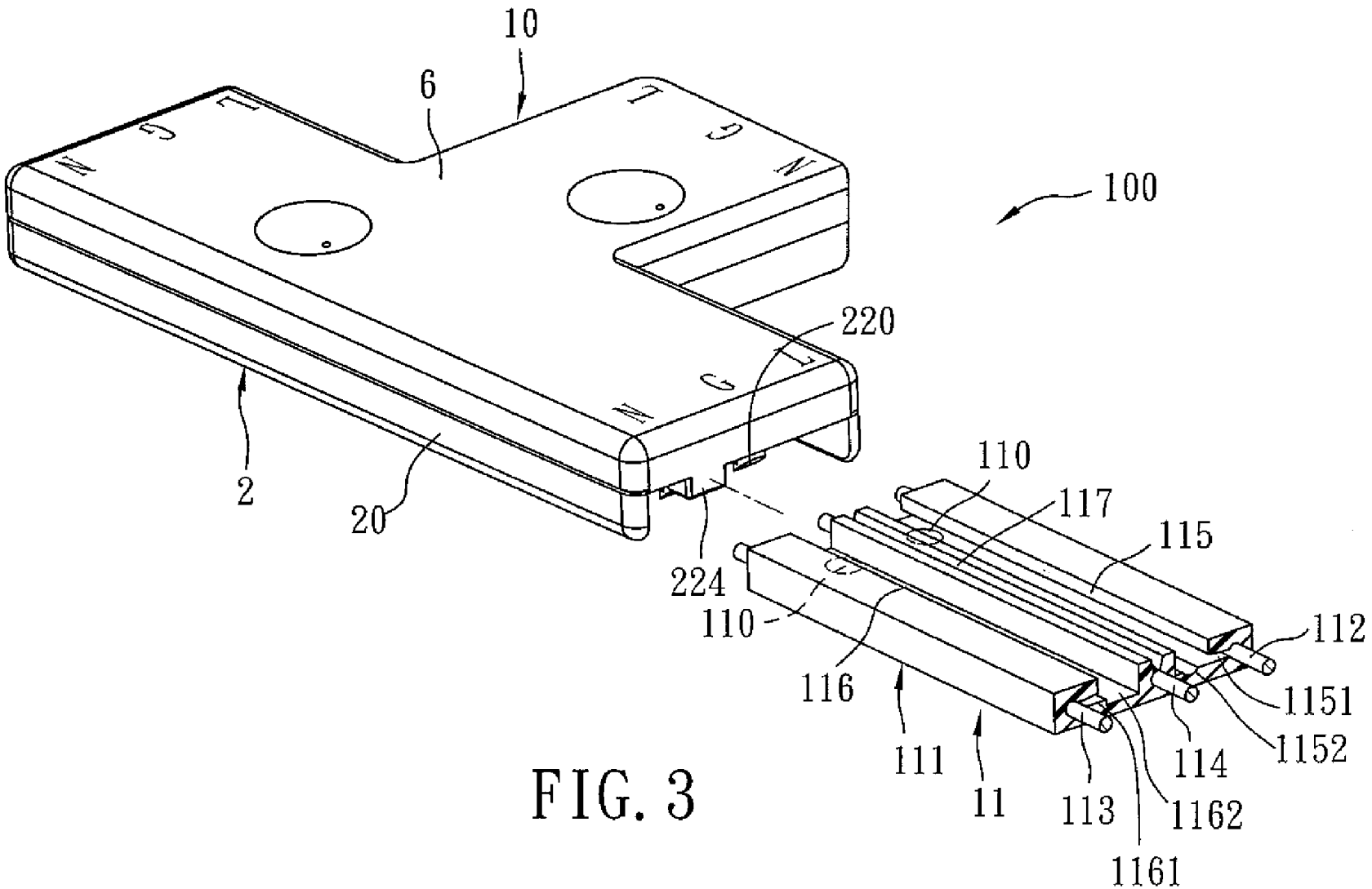
FIG. 3 is an exploded perspective view of the electrical connector and an electrical track of the first preferred embodiment.
Figure 4:
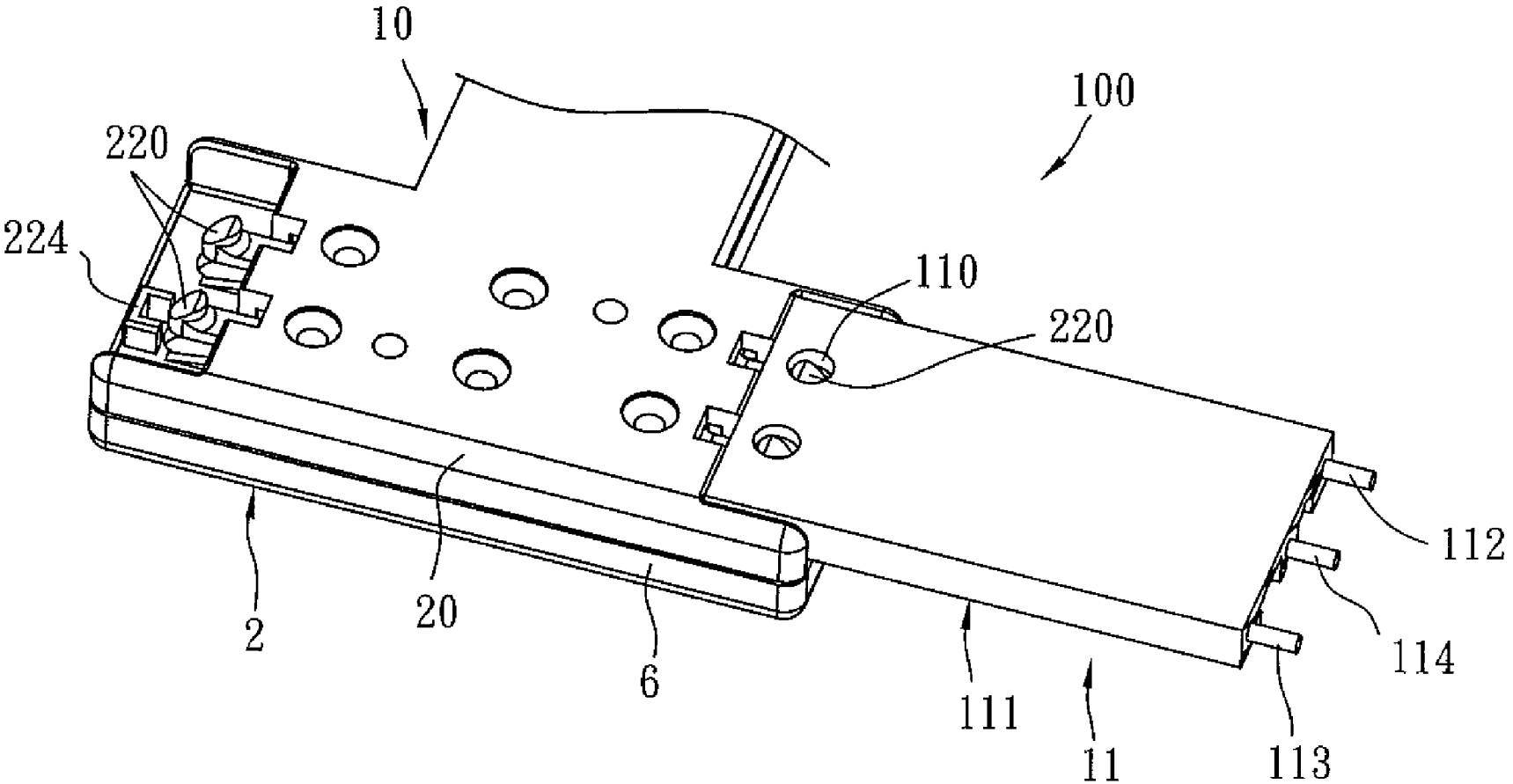
FIG. 4 is an assembled bottom view of FIG. 3.
Figure 5:
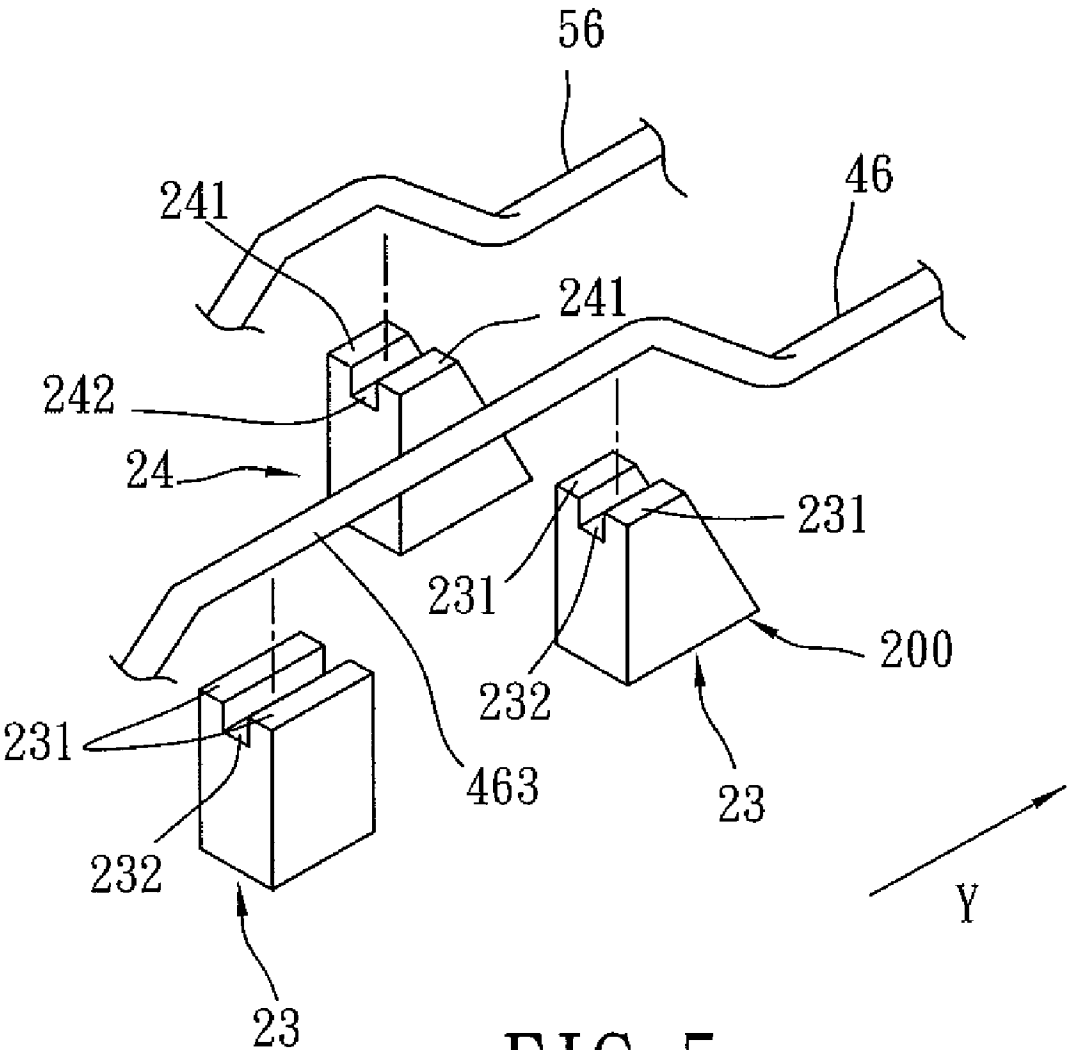
FIG. 5 is an enlarged perspective view of a wire prop-up unit of the first preferred embodiment.

Before the present invention is described in greater detail, it should be noted that like elements are denoted by the same reference numerals throughout the disclosure.

FIG. 1 illustrates a fragmentary schematic view of an electric distributing system 1 that incorporates the first preferred embodiment of an electrical track and connector assembly 100 according to the present invention. The electric distributing system 1 includes three electrical tracks 11, at least one movable electrical receptacle 12 connected electrically to one of the electrical tracks 11, and a power supply plug 13 connected electrically to one of the electrical tracks 11. The power supply plug 13 is also connected electrically to a fixed electrical receptacle 14 for supply of electrical power to the electric distributing system 1. Each of the fixed and movable electrical receptacles 14, 12 has a hot line, a neutral line, and a ground line.

Referring to FIGS. 2 to 5, the first preferred embodiment of the electrical track and connector assembly 100 according to the present invention is shown to comprise three electrical tracks 11 (only one is shown), and an electrical connector 10.

Each of the electrical tracks 11 includes a track body 111, a first track wire 112 adapted to be connected electrically to the hot line of the fixed or movable electrical receptacle 14, 12, a second track wire 113 spaced apart from the first track wire 112 and adapted to be connected electrically to the neutral line of the fixed or movable electrical receptacle 14, 12, and a track ground wire 114 disposed between the first and second track wires 112, 113 and adapted to be connected electrically to the ground line of the fixed or movable electrical receptacle 14, 12. The track body 111 of each electrical track 11 has first and second grooves 115, 116, and a third groove 117 between the first and second grooves 115, 116 to receive the track ground wire 114 therein. Each of the first and second grooves 115, 116 includes a wire-receiving section 1151, 1161, and a rib-receiving section 1152, 1162 in spatial communication with the wire-receiving section 1151, 1161. The first to third grooves 115, 116, 117 extend along the first and second track wires 112, 113. The first and second track wires 112, 113 are received in the wire-receiving sections 1151, 1161 of the respective first and second grooves 115, 116. The track body 111 of each electrical track 11 further has two opposite ends each provided with two spaced-apart engaging holes 110. The first groove 115 has an opening with a width narrower than the width of an opening of the second groove 116.

The electrical connector 10 includes a housing 2, first and second conductive wire units 3, 4, and a ground wire unit 5. The housing 2 has three connecting end portions (22*a*, 22*b*, 22*c*) connected respectively to the electrical tracks 11, and a wire prop-up unit 200. The connecting end portions (22*a*, 22*b*, 22*c*) are respectively located along track directions (X, X', Y), which all lie on the same plane. The track direction (X') is opposite to the track direction (X), while the track direction (Y) is perpendicular to both of the track directions (X, X'). In particular, the housing 2 is made up of a T-shaped base 20 and a T-shaped cover 6. The base 20 includes a first base wall 211, and a second base wall 212 perpendicular to the first base wall 211. The connecting end portions (22*a*, 22*b*) are respectively located on two opposite sides of the first base wall 211, while the connecting end portion (22*c*) is located on a distal end of the second base wall 212. The cover 6 is screwed fixedly to the base 2, and has three labeling portions 611 provided on an outer surface 61 thereof and located at positions corresponding to the connecting end portions (22*a*, 22*b*, 22*c*). Each labeling portion 611 has three symbols 612, namely, "L" to represent a hot (or live) line position, "N" to represent a neutral line position, and "G" to represent a ground line position.

The wire prop-up unit 200 includes two wire-supporting blocks 23 and a ground block 24 all projecting from an inner surface of the first base wall 211 of the base 20. Each of the wire-supporting and ground blocks 23, 24 has an indentation 232, 242 disposed away from the inner surface of the first base wall 211 and defined by two clamp parts 231, 241. The indentations 232, 242 of the wire-supporting and ground blocks 23, 24 are disposed away from the inner surface of the first base wall 211 at the same height. The indentations 232 of the wire-supporting blocks 23 are aligned along the track direction (Y), while the indentation 242 of the ground block 24 is parallel to the indentations 232 of the wire-supporting blocks 23.

The housing 2 further includes an aligning rib 224 provided on each of the connecting end portions (22*a*, 22*b*, 22*c*) (only the aligning rib 224 at the connecting end portion (22*a*) is visible) to extend solely into the second groove 116 of the corresponding electrical track 11, and two engaging hooks 220 also provided on each of the connecting end portions (22*a*, 22*b*, 22*c*) to engage the respective engaging holes 110 at one end of the corresponding electrical track 11. The aligning rib 224 can ensure alignment so that the electrical connector 10 can be connected correctly to the electrical track 11. Further, through engagement of the engaging hooks 220 and the engaging holes 110, the electrical connector 10 can be assuredly positioned on the electrical track 11.

The first conductive wire unit 3 is disposed in the housing 2, and includes three first terminals 31, 32, 33 respectively disposed in the connecting end portions (22*a*, 22*b*, 22*c*) and connected electrically and respectively to the first track wires 112 of the electrical tracks 11, and a first intermediate portion 30 interconnecting the first terminals 31, 32, 33. The first intermediate portion 30 has three first wires 35, 36, 39, and a connecting member 34 interconnecting the first wires 35, 36, 39. After assembly, the first wire 35 extends along the track direction (X'), and is connected to the first terminal 32. The first wire 36 extends along the track direction (Y), and is connected to the first terminal 33. The first wire 39 extends along the track direction (X), and is connected to the first terminal 31.

The second conductive wire unit 4 is disposed in the housing 2, and includes three second terminals 41, 42, 43 respectively disposed in the connecting end portions (22*a*, 22*b*, 22*c*) and connected electrically and respectively to the second track wires 113 of the electrical tracks 11, and a second intermediate portion 40 interconnecting the second terminals 41, 42, 43. The second intermediate portion 40 has three second wires 45, 46, 49, and a connecting member 44 interconnecting the second wires 45, 46, 49. The second wire 45 extends along the track direction (X), and is connected to the second terminal 41. The second wire 49 extends along the track direction (X'), and is connected to the second terminal 42. The second wire 46 extends along the track direction (Y), and is connected to the second terminal 43. The second wire 46 has two holding sections 461, 462 respectively fixed to the connecting member 44 and the second terminal 43, and a first bent rising section 463 connected between the holding sections 461, 462. The first bent rising section 463 is retained in the indentations 232 of the wire-supporting blocks 23, and is clamped between the clamp parts 231 of the wire-supporting blocks 23.

The ground wire unit 5 is disposed in the housing 2, and includes three ground terminals 51, 52, 53 respectively disposed in the connecting end portions (22*a*, 22*b*, 22*c*) and connected electrically and respectively to the track ground wires 114 of the electrical tracks 11, and a ground intermediate portion 50 interconnecting the ground terminals 51, 52, 53. The ground intermediate portion 50 has three ground wires 55, 56, 59, and a connecting member 54 interconnecting the ground wires 55, 56, 59. The ground wire 55 extends along the track direction (X), and is connected to the ground terminal 51. The ground wire 56 extends along the track direction (Y), and is connected to the ground terminal 53. The ground wire 59 extends along the track direction (X'), and is connected to the ground terminal 52. The ground wire 56 has two holding sections 561, 562 respectively fixed to the ground terminal 53 and the connecting member 54, and a second bent rising section 563 connected between the holding sections 561, 562. The second bent rising section 563 is retained in the indentation 242 of the ground block 24, is clamped between the clamp parts 241, and extends across the first wire 35 without contact therewith.

The first bent rising section 463 of the second wire 46 extends across the first wire 35 and the ground wire 59 without contact therewith.

Figure 6:
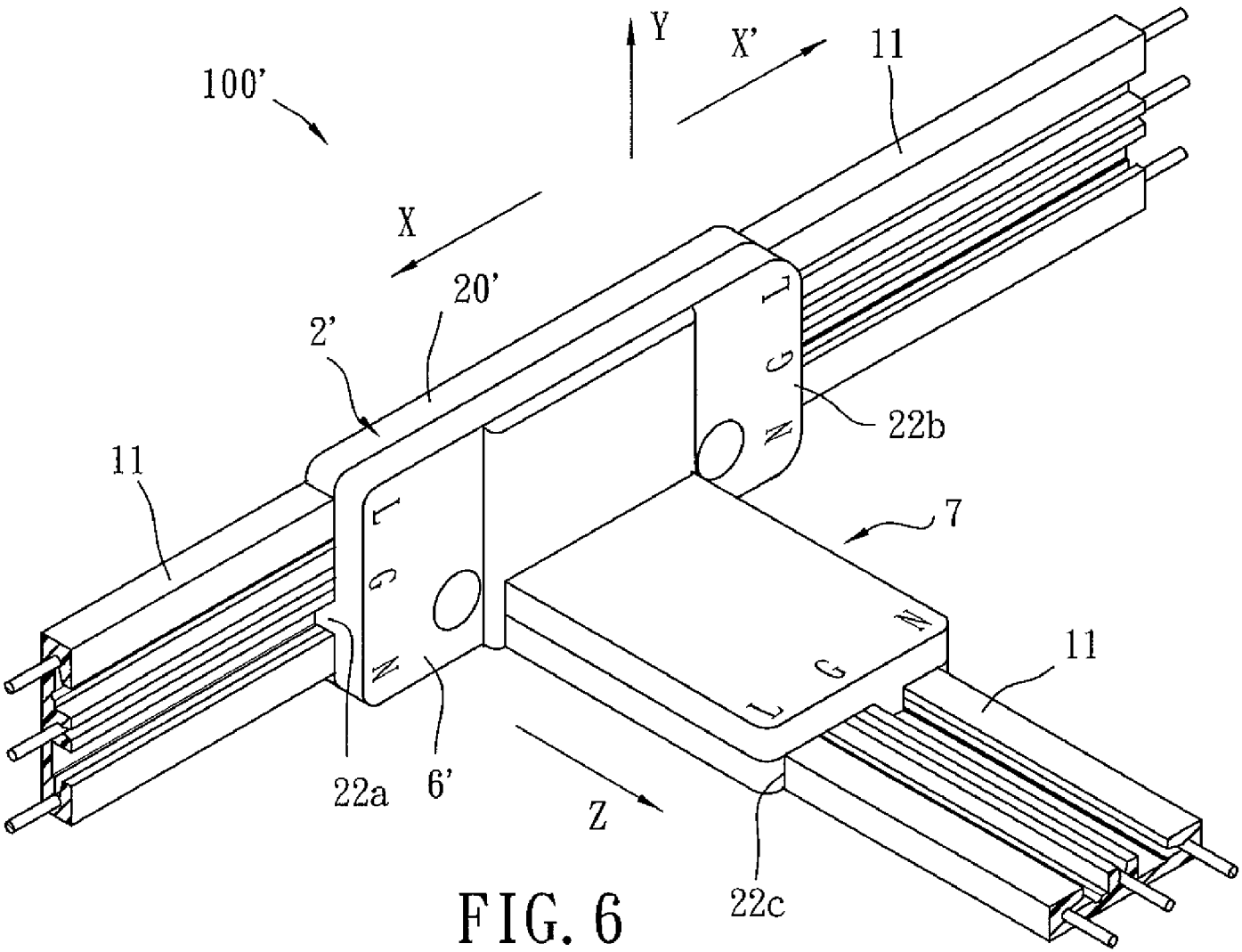
FIG. 6 is a perspective view of an electrical track and connector assembly according to the second preferred embodiment of the present invention.
Figure 7:
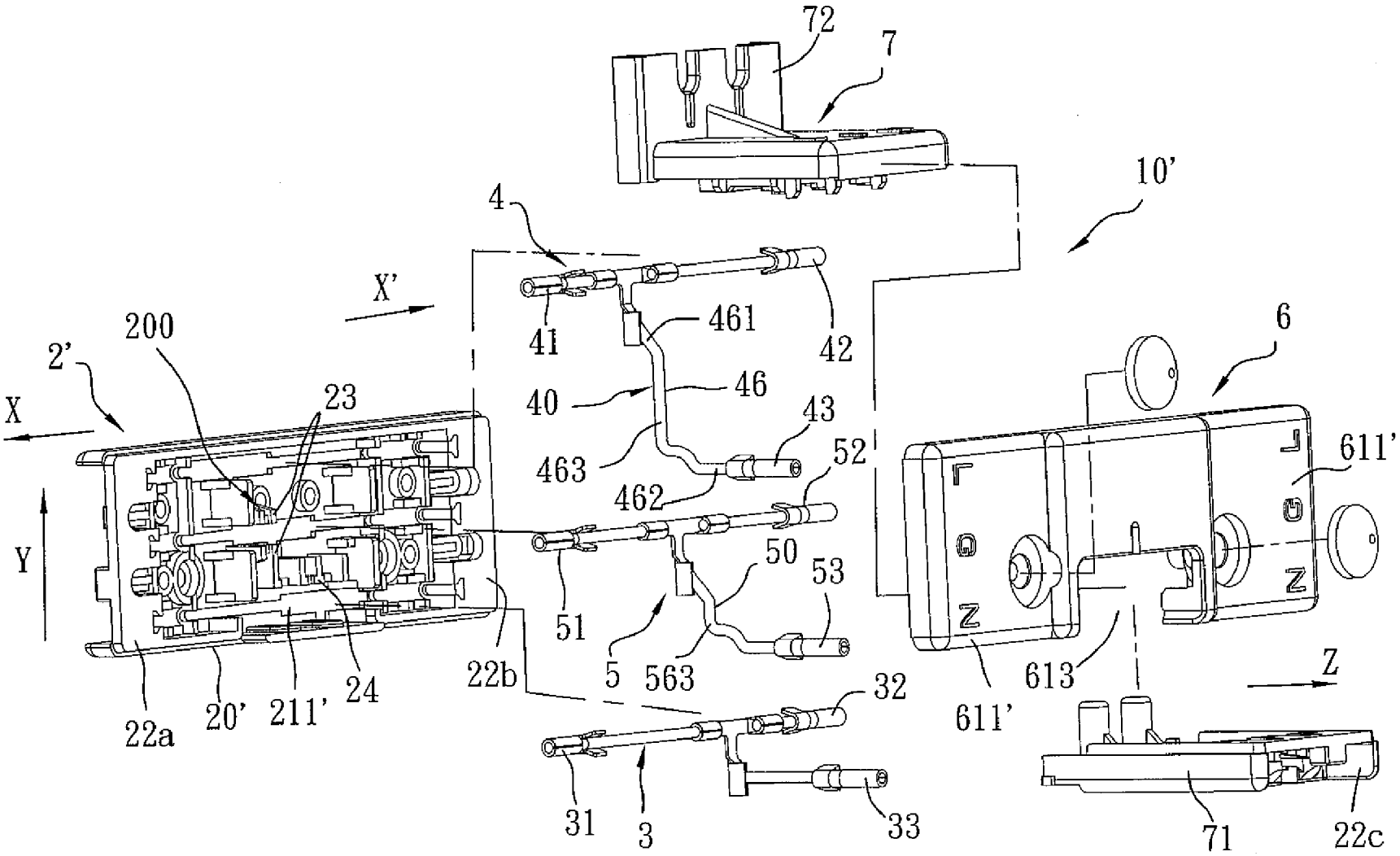
FIG. 7 is an exploded perspective view of an electrical connector of the second preferred embodiment.

Referring to FIGS. 6 and 7, the electrical track and connector assembly 100' according to the second preferred embodiment of the present invention is shown to be similar to the first preferred embodiment. Particularly, the connecting end portions (22*a*, 22*b*) of the housing 2' of the electrical connector 10' respectively extend along the track directions (X, X') which both lie on the same plane. However, in this embodiment, the connecting end portion (22*c*) extends along a track direction (Z), which is perpendicular to the track directions (X, X'), but which lies on a plane perpendicular to that of the track directions (X, X'). The housing 2' of the electrical connector 10' includes a rectangular first base 20' having a base wall 211' a rectangular first cover 6' screwed fixedly to the first base 20', and an extension seat 7.

The connecting end portions (22*a*, 22*b*) are respectively located on two opposite sides of the base wall 211' of the base 20'. The cover 6' has two labeling portions 611' located at positions corresponding to the connecting end portions (22*a*, 22*b*) and a cutout portion 613 between the labeling portions 611'. The extension seat 7 extends along the track direction (Z), and has one end inserted into the cutout portion 613. The extension seat 7 includes a rectangular second base 71 having a function similar to that of the first base 20', and a rectangular second cover 72 fixed to the second base 71 and having a function similar to that of the first cover 6'. The connecting end portion (22*c*) is located on an end of the extension seat 7 distal from the cutout portion 613, i.e., opposite the end inserted into the cutout portion 613.

The wire prop-up unit 200 similarly includes two wire-supporting blocks 23 and a ground block 24 all projecting from an inner surface of the base wall 211' of the first base 20'.

In this embodiment, the first terminals 31, 32, 33 of the first conductive wire unit 3 are connected electrically and respectively to the second track wires 113 of the electrical tracks 11, while the second terminals 41, 42, 43 of the second conductive wire unit 4 are connected electrically and respectively to the first track wires 112 of the electrical tracks 11. The second intermediate portion 40 of the second conductive wire unit 4 has a structure similar to that of the first preferred embodiment, and has the first bent rising section 463 similarly supported and retained on the wire-supporting blocks 23. The structure of the ground intermediate portion 50 of the ground wire unit 5 is similar to that of the second intermediate portion 40. However, the second bent rising section 563 is shorter than the first bent rising section 463, and is supported and retained on the second block 24.

Figure 8:
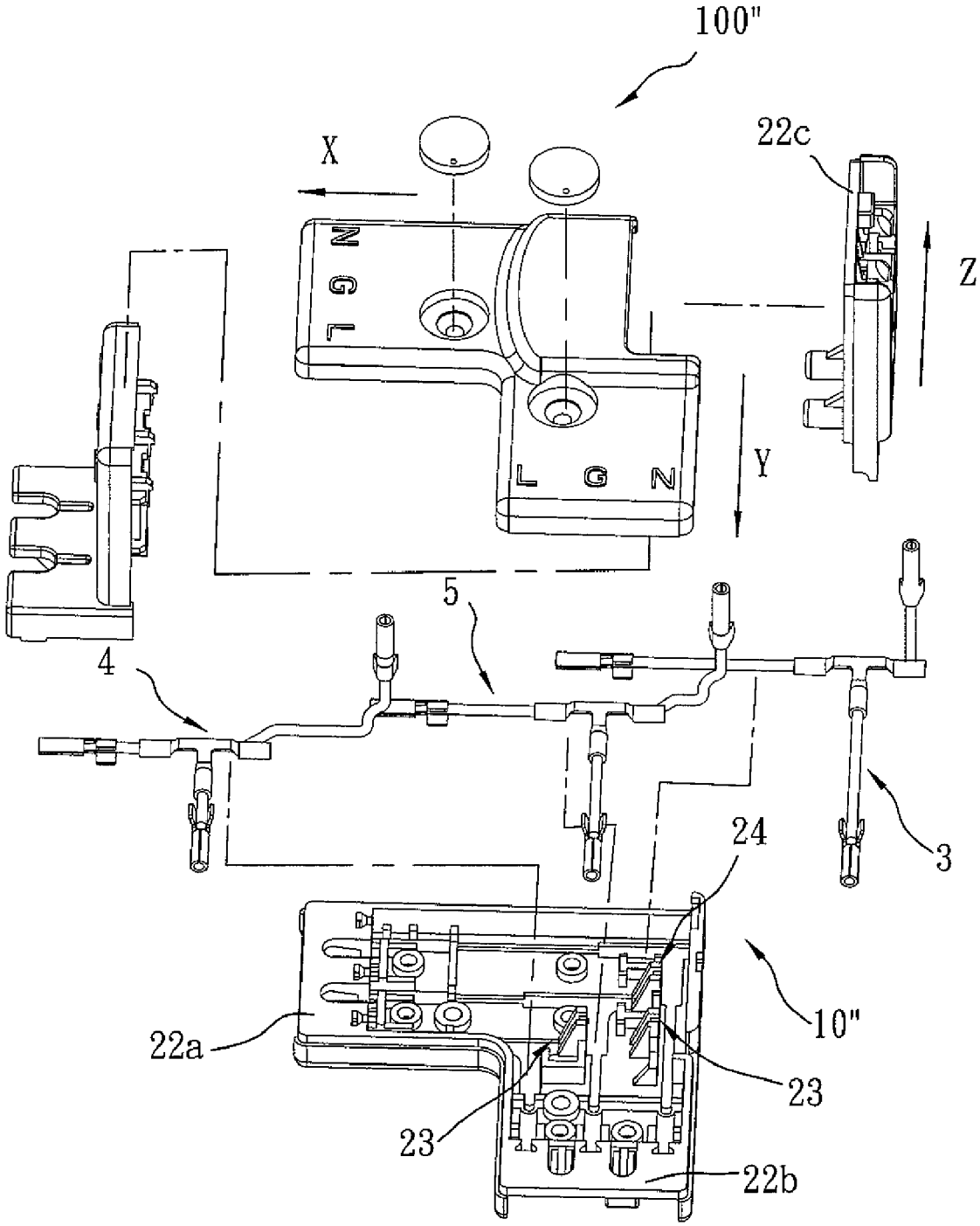
FIG. 8 is an exploded perspective view of an electrical connector according to the third preferred embodiment of the present invention.

FIG. 8 illustrates an electrical connector 10" of the electrical track and connector assembly 100" according to the third preferred embodiment of the present invention. The third preferred embodiment is shown to be similar to the second preferred embodiment. However, in this embodiment, the connecting end portion (22*a*) extends along the track direction (X), the connecting end portion (22*b*) extends along the track direction (Y) which is perpendicular to the track direction (X), and the connecting end portion (22*c*) extends along the track direction (Z) which is perpendicular to both of the track directions (X, Y).

Figure 9:
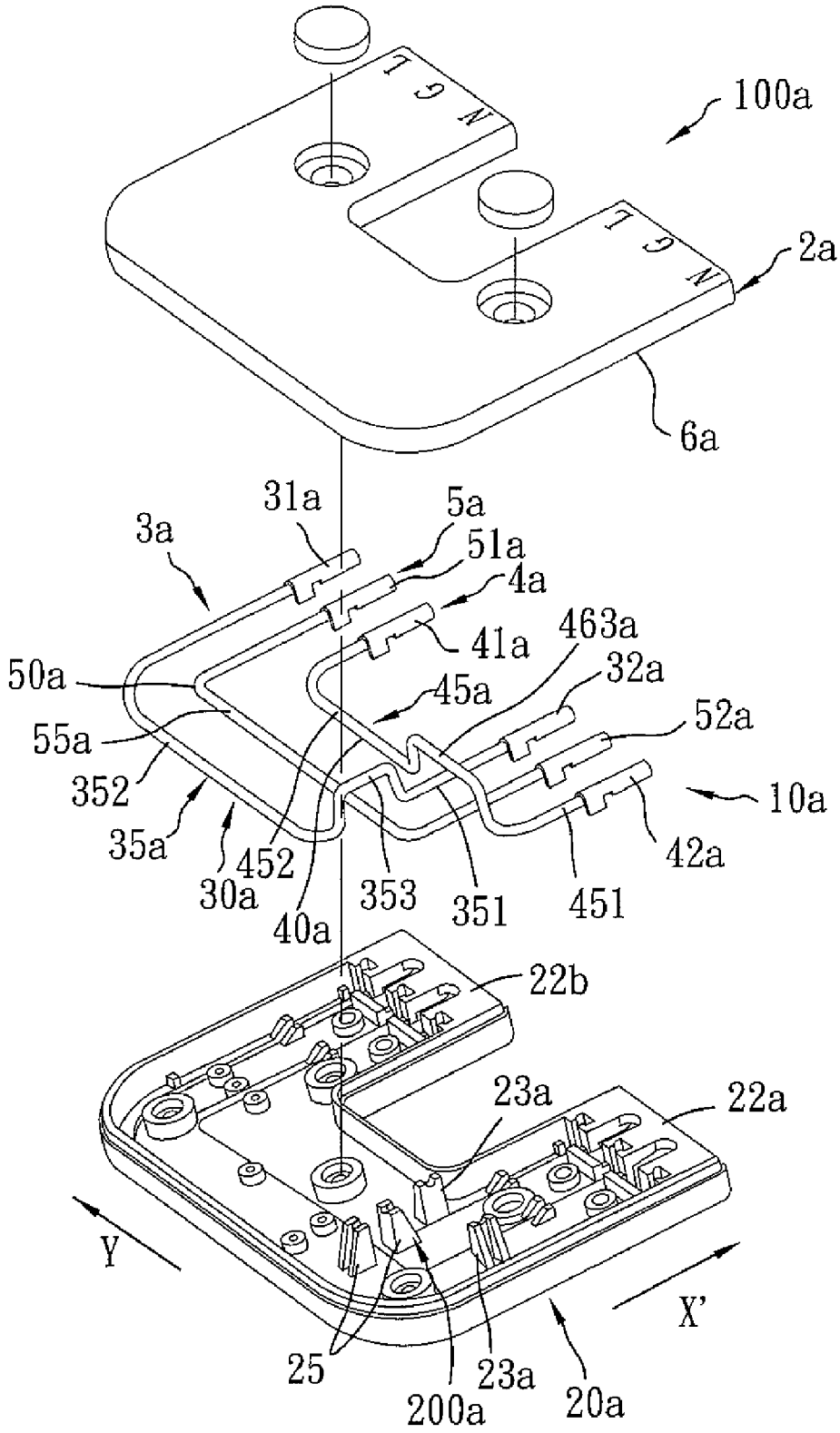
FIG. 9 is an exploded perspective view of an electrical connector according to the fourth preferred embodiment of the present invention.

FIG. 9 illustrates an electrical connector (10*a*) of the electrical track and connector assembly (10*a*) according to the fourth preferred embodiment of the present invention. The electrical connector (10*a*) includes a housing (2*a*), first and second conductive wire units (3*a*, 4*a*), and a ground wire unit (5*a*). The housing (2*a*) has two connecting end portions (22*a*, 22*b*) connected respectively to two electrical tracks 11 (see FIG. 1) and defined by a U-shaped base (20*a*) and a U-shaped cover (6*a*) screwed fixedly to the base (20*a*), and a wire prop-up unit (200*a*). The connecting end portions (22*a*, 22*b*) are spaced apart from each other, and extend substantially parallel to each other along the track direction (X'). The wire prop-up unit (200*a*) includes four wire-supporting blocks (23*a*, 25) projecting from an inner surface of the base (20*a*). Two of the wire-supporting blocks 25 are aligned along the track direction (X'). The other two of the wire-supporting blocks (23*a*) are aligned along the track direction (Y).

The first conductive wire unit (3*a*) includes two first terminals (31*a*, 32*a*) respectively disposed in the connecting end portions (22*a*, 22*b*) and connected electrically and respectively to the first track wires 112 (see FIG. 3) of the electrical tracks 11, and a first intermediate portion (30*a*) interconnecting the first terminals (31*a*, 32*a*). The first intermediate portion (30*a*) has a first wire (35*a*) that includes two connecting sections 351, 352 respectively connected to the first terminals (31*a*, 32*a*) and a first bent rising section 353 between the connecting sections 351, 352.

The second conductive wire unit (4*a*) includes two second terminals (41*a*, 42*a*) respectively disposed in the connecting end portions (22*a*, 22*b*) and connected electrically and respectively to the second track wires 113 (see FIG. 3) of the electrical tracks 11, and a second intermediate portion (40*a*) interconnecting the second terminals (41*a*, 42*a*). The second intermediate portion (40*a*) has a second wire (45*a*) including two connecting sections 451, 452 respectively connected to the second terminals (41*a*, 42*a*), and a first bent rising section (463*a*) between the connecting sections 451, 452. The ground wire unit (5*a*) includes two ground terminals (51*a*, 52*a*) respectively disposed in the connecting end portions (22*a*, 22*b*) and connected electrically and respectively to the track ground wires 114 (see FIG. 3) of the electrical tracks 11, and a substantially U-shaped ground intermediate portion (50*a*) interconnecting the ground terminals (51*a*, 52*a*). The ground intermediate portion (50*a*) has a ground wire (55*a*) laid on the inner surface of the base (20*a*). Hence, the electrical track and connector assembly (10*a*) can provide a different connection configuration with the electrical tracks 11. The first bent rising section 353 of the first wire (35*a*) is retained on the wire-supporting blocks 25, and extends across the ground wire (55*a*) without contact therewith. The first bent rising section (463*a*) of the second wire (45*a*) is retained on the wire-supporting blocks (23*a*), and extends across the connecting section 351 of the first wire (35*a*) and the ground wire (55*a*) without contact therewith.

Figure 10:
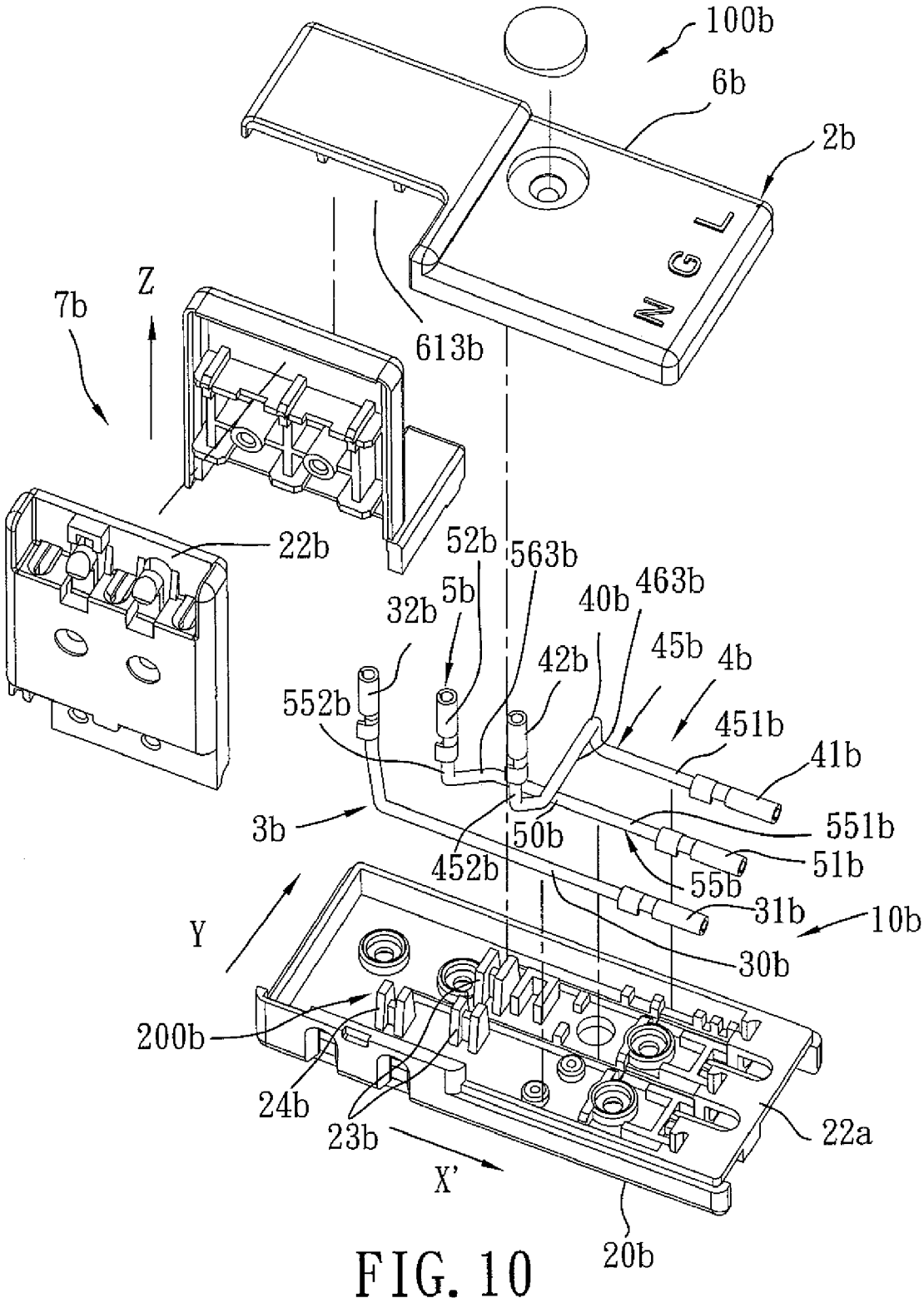
FIG. 10 is an exploded perspective view of an electrical connector according to the fifth preferred embodiment of the present invention.

FIG. 10 illustrates an electrical connector (10*b*) of the electrical track and connector assembly (100*b*) according to the fifth preferred embodiment of the present invention. The electrical connector (10*b*) includes a housing (2*b*), first and second conductive wire units (3*b*, 4*b*), and a ground wire unit (5*b*). The housing (2*b*) has two connecting end portions (22*a*, 22*b*) connected respectively to two electrical tracks 11 (see FIG. 1) and defined by a first base (20*b*), a first cover (6*b*), and an extension seat (7*b*), and a wire prop-up unit (200*b*). The first cover (6*b*) is screwed fixedly to the first base (20*b*), and has a cutout portion (613*b*). The wire prop-up unit (200*b*) includes two wire-supporting blocks (23*b*) and a ground block (24*b*) all projecting from an inner surface of the first base (20*b*). The extension seat (7*b*) extends along the track direction (Z), and has one end inserted into the cutout portion (613*b*). The connecting end portion (22*a*) is located on a distal end of the first base (20*b*), while the connecting end portion (22*b*) is located on another end of the extension seat (7*b*) distal from the cutout portion (613*b*).

The first conductive wire unit (3*b*) includes two first terminals (31*b*, 32*b*) disposed respectively in the connecting end portions (22*a*, 22*b*) and connected electrically and respectively to the second track wires 113 (see FIG. 3) of the electrical tracks 11, and a substantially L-shaped first intermediate portion (30*b*) interconnecting the first terminals (31*b*, 32*b*).

The second conductive wire unit (4*b*) includes two second terminals (41*b*, 42*b*) disposed respectively in the connecting end portions (22*a*, 22*b*) and connected electrically and respectively to the first track wires 112 (see FIG. 3) of the electrical tracks 11, and a second intermediate portion (40*b*) interconnecting the second terminals (41*b*, 42*b*). The second intermediate portion (40*b*) has a second wire (45*b*) with two connecting sections (451*b*, 452*b*) connected respectively to the second terminals (41*b*, 42*b*), and a first bent rising section (463*b*) connected between the connecting sections (451*b*, 452*b*).

The ground wire unit (5*b*) has two ground terminals (51*b*, 52*b*) respectively disposed in the connecting end portions (22*a*, 22*b*) and connected electrically and respectively to the track ground wires 114 (see FIG. 3) of the electrical tracks 11, and a ground intermediate portion (50*b*) interconnecting the ground terminals (51*b*, 52*b*). The ground intermediate portion (50*b*) has a ground wire (55*b*) with two connecting sections (551*b*, 552*b*) connected respectively to the ground terminals (51*b*, 52*b*), and a second bent rising section (563*b*) connected between the connecting sections (551*b*, 552*b*). The first bent rising section (463*b*) is supported and retained on the wire-supporting blocks (23*b*), and extends across the intermediate portion (30*b*) of the first conductive wire unit (3*b*) and the connecting section (551*b*) of the ground wire (55*b*) without contact therewith. The second bent rising section (563*b*) is supported and retained on the ground block (24*b*), and extends across the intermediate portion (30*b*) of the first conductive wire unit (3*b*) without contact therewith.

Figure 11:
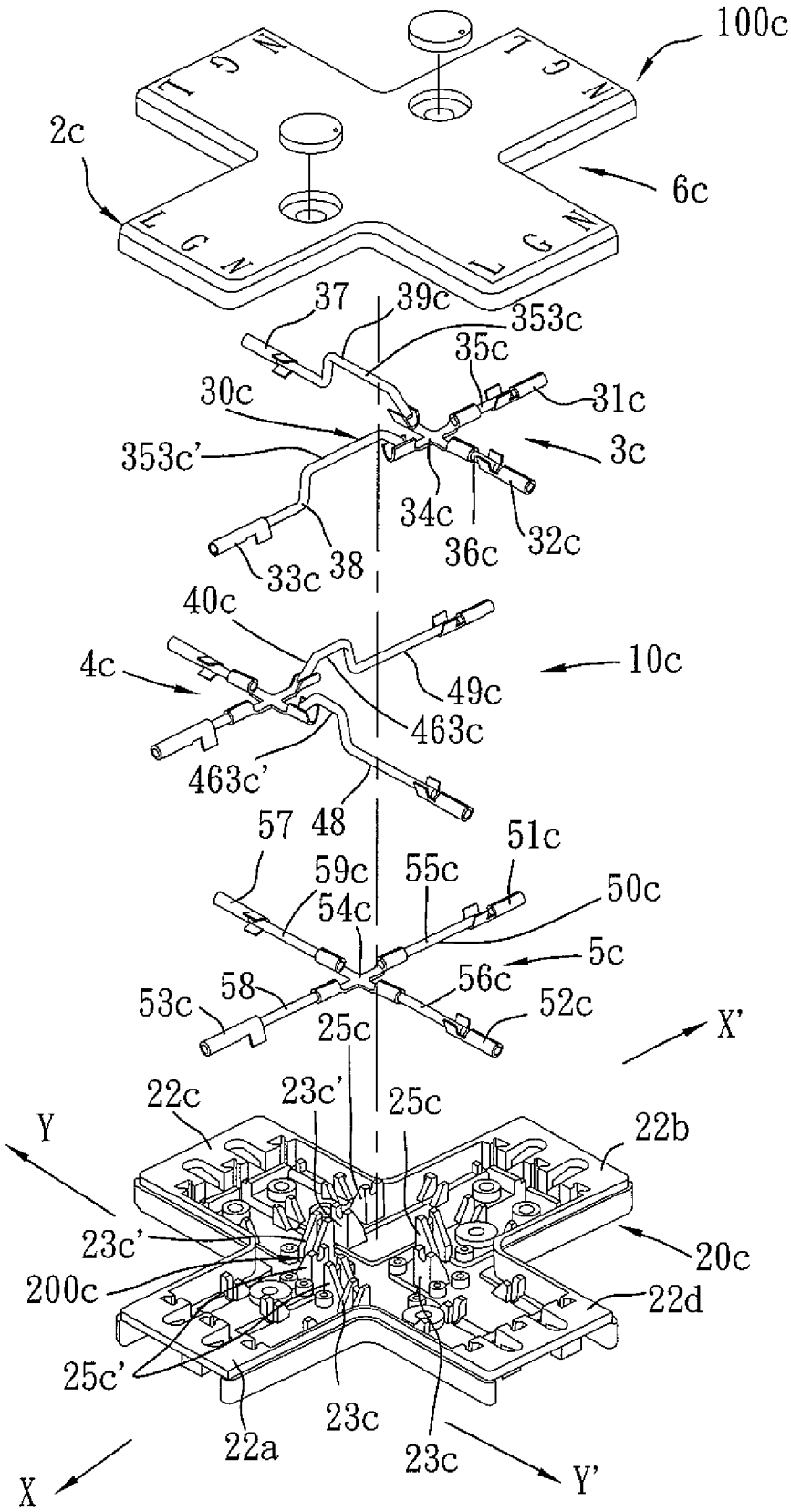
FIG. 11 is an exploded perspective view of an electrical connector according to the sixth preferred embodiment of the present invention.

FIG. 11 illustrates an electrical connector (10*c*) of the electrical track and connector assembly (10*c*) according to the sixth preferred embodiment of the present invention. The electrical connector (10*c*) includes a housing (2*c*) having four connecting end portions (22*a*, 22*b*, 22*c*, 22*d*) connected respectively to four electrical tracks 11 (only three are shown in FIG. 1) and defined by a cross-shaped base (20*c*) and a cross-shaped cover (6*c*) screwed fixedly to the base (20*c*), first and second conductive wire units (3*c*, 4*c*), a ground wire unit (5*c*), and a wire prop-up unit (200*c*). The connecting end portions (22*a*, 22*b*, 22*c*, 22*d*) extend respectively along the track directions (X, X', Y, Y'), which all lie on the same plane. The wire prop-up unit (200*c*) includes two pairs of aligned wire-supporting first blocks (23*c*, 23*c*') and two pairs of aligned wire-supporting second blocks (25*c*, 25*c*') all projecting from an inner surface of the base wall (211*c*) of the base (20*c*). The first blocks (23*c*, 23*c*') are arranged along the track directions (X, X'), while the second blocks (25*c*, 25*c*') are arranged along the track directions (Y, Y').

In this embodiment, the first conductive wire unit (3*c*) includes four first terminals (33*c*, 31*c*, 37, 32*c*) respectively disposed in the connecting end portions (22*a*, 22*b*, 22*c*, 22*d*) and connected electrically and respectively to the first track wires 112 (see FIG. 3) of the electrical tracks 11, and a first intermediate portion (30*c*) interconnecting the first terminals (31*c*, 32*c*, 33*c*, 37). The first intermediate portion (30*c*) has four first wires (35*c*, 36*c*, 39*c*, 38) respectively connected to the first terminals (31*c*, 32*c*, 37, 33*c*), and a connecting member (34*c*) interconnecting the first wires (35*c*, 36*c*, 39*c*, 38). The first wire (39*c*) has a first bent rising section (353*c*) retained on the second blocks (25*c*). The first wire 38 has a first bent rising section (353*c*') retained on the first blocks (23*c*).

The second conductive wire unit (4*c*) in this embodiment, has a construction similar to that of the first conductive wire unit (3*c*). The only difference between the first and second conductive wire units (3*c*, 4*c*) resides in that the second wires (49*c*, 48) of the second intermediate portion (40*c*) are disposed opposite to the first wires (38, 39*c*) of the first intermediate portion (30*c*), respectively. Hence, the first bent rising section (463*c*) of the second wire (49*c*) is retained on the first blocks (23*c*') and the first bent rising section (463*c*') of the second wire 48 is retained on the second blocks (25*c*').

The ground wire unit (5*c*) includes four ground terminals (53*c*, 51*c*, 57, 52*c*) respectively disposed in the connecting end portions (22*a*, 22*b*, 22*c*, 22*d*), and a ground intermediate portion (50*c*) interconnecting the ground terminals (51*c*, 52*c*, 53*c*, 57). The ground intermediate portion (50*c*) has four ground wires (55*c*, 56*c*, 59*c*, 58) respectively connected to the ground terminals (51*c*, 52*c*, 57, 53*c*), and a connecting member (54*c*) interconnecting the ground wires (55*c*, 56*c*, 59*c*, 58). The first bent rising section (353*c*) of the first wire (39*c*) extends across the second wire (49*c*) and the ground wire (55*c*) without contact therewith. The first bent rising section (353*c*') of the first wire 38 extends across the second wire 48 and the ground wire (56*c*) without contact therewith. The first bent rising sections (463*c*, 463*c*') of the second wires (49*c*, 48) extend respectively across the ground wires (59*c*, 58) without contact therewith.

Figure 12:
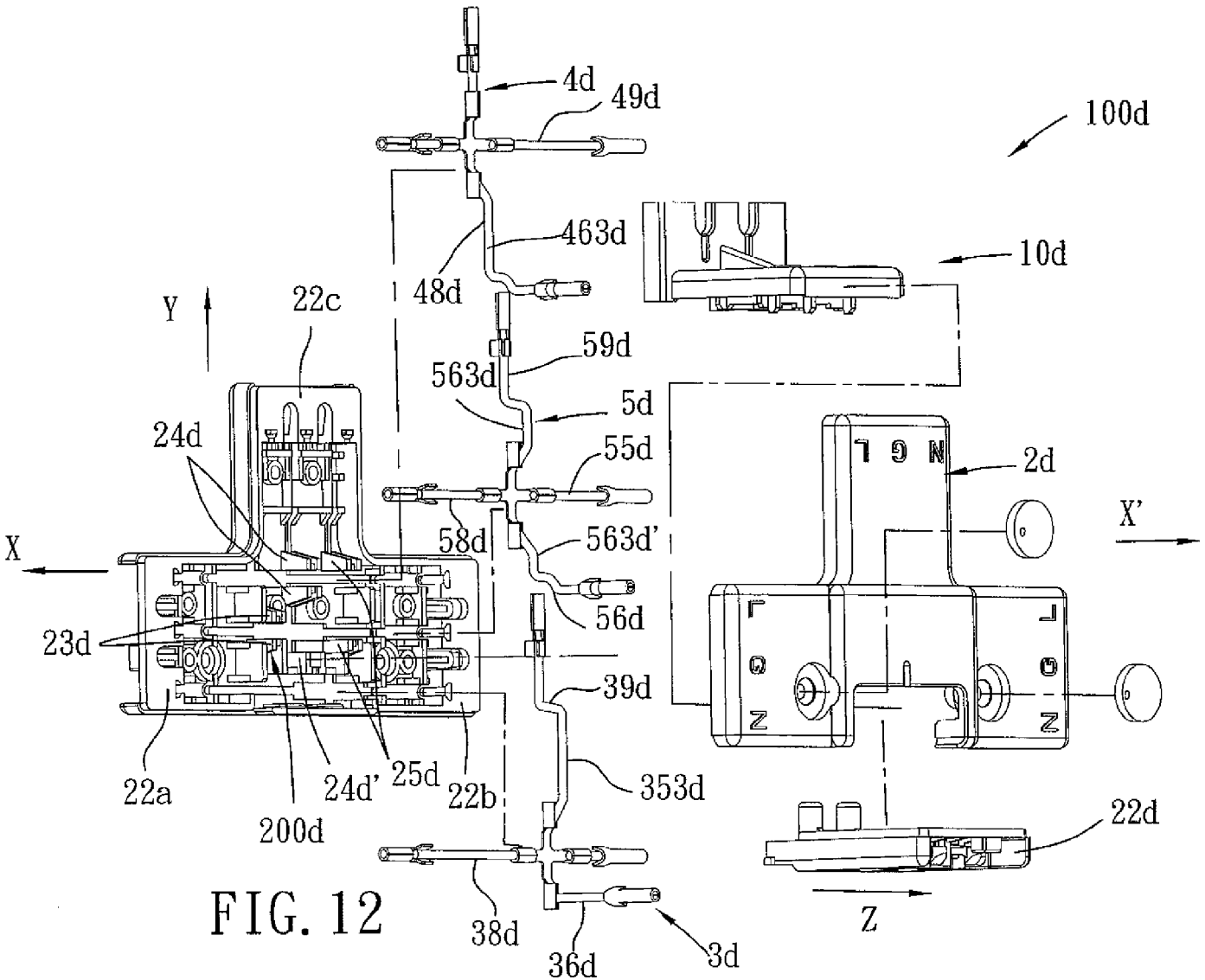
FIG. 12 is an exploded perspective view of an electrical connector according to the seventh preferred embodiment of the present invention.

FIG. 12 illustrates an electrical connector (10*d*) of the electrical track and connector assembly (100*d*) according to the seventh preferred embodiment of the present invention. The seventh preferred embodiment is shown to be similar to the sixth preferred embodiment. In the sixth preferred embodiment, the four connecting end portions (22*a*, 22*b*, 22*c*, 22*d*) are located on the same plane. However, in this embodiment, the connecting end portions (22*a*, 22*b*, 22*c*) are located on the same plane, while the connecting end portion (22*d*) is located on a plane perpendicular to that of the connecting end portions (22*a*, 22*b*, 22*c*). The wire prop-up unit (200*d*) includes two aligned wire-supporting first blocks (23*d*), two aligned wire-supporting second blocks (25*d*), and three ground blocks (24*d*, 24*d*') two of which are aligned with each other. The first bent rising section (353*d*) of the first wire (39*d*) is retained on the second blocks (25*d*), and extends across the second wire (49*d*) and the ground wire (55*d*) without contact therewith. The first bent rising section (463*d*) of the second wire (48*d*) is retained on the first blocks (23*d*), and extends across the ground wire (58*d*) and the first wire (38*d*) without contact therewith. The second bent rising section (563*d*) of the ground wire (59*d*) is retained on the ground blocks (24*d*), and extends across the second wire (49*d*) without contact therewith. The second bent rising section (563*d*' of the ground wire (56*d*) is retained on the ground block (24*d*'), and extends across the first wire (38*d*) without contact therewith.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An electrical track and connector assembly comprising:

at least two electrical tracks, each of which includes first and second track wires spaced apart from each other; and an electrical connector including a housing having at least two connecting end portions connected respectively to said electrical tracks, and a wire prop-up unit projecting from an inner surface of said housing, and first and second conductive wire units disposed in said housing, said first conductive wire unit including at least two first terminals respectively disposed in said connecting end portions and connected electrically and respectively to said first track wires of said electrical tracks, and a first intermediate portion interconnecting said first terminals, said second conductive wire unit including at least two second terminals respectively disposed in said connecting end portions and connected electrically and respectively to said second track wires of said electrical tracks, and a second intermediate portion interconnecting said second terminals, at least one of said first and second intermediate portions having at least one first bent rising section held by said wire prop-up unit and extending across the other one of said first and second intermediate portions without contact therewith.

2. The electrical track and connector assembly of claim 1, wherein said housing further includes abase having said inner surface, said wire prop-up unit including a block projecting from said inner surface and having an indentation disposed away from said inner surface of said base to retain therein said first bent rising section of said one of said first and second intermediate portions.

3. The electrical track and connector assembly of claim 1, wherein each of said electrical tracks further includes a track ground wire disposed between said first and second track wires, said electrical connector further including a ground wire unit having at least two ground terminals respectively disposed in said connecting end portions and connected electrically and respectively to said track ground wires of said electrical tracks, and a ground intermediate portion interconnecting said ground terminals.

4. The electrical track and connector assembly of claim 1, wherein each of said electrical tracks further includes a track body having two grooves extending along said first and second track wires, said grooves having an opening, said openings of said grooves having different widths, said electrical connector further including an aligning rib provided on each of said connecting end portions to extend solely into a particular one of said grooves.

5. The electrical track and connector assembly of claim 4, wherein said track body of each of said electrical tracks further has two spaced-apart engaging holes, said electrical connector further including two engaging hooks provided on each of said connecting end portions to engage said engaging holes, respectively.

6. The electrical track and connector assembly of claim 3, which comprises three said electrical tracks, wherein said housing has three said connecting end portions extending in three different directions, each of said first and second intermediate portions and said ground intermediate portion having three interconnected wires, one of said interconnected wires of said second intermediate portion having said first bent rising section held by said wire prop-up unit and extending across one of said interconnected wires of said first intermediate portion and one of said interconnected wires of said ground intermediate portion without contact therewith, one of said interconnected wires of said ground intermediate portion having a second bent rising section held by said wire prop-up unit and extending across one of said interconnected wires of said first intermediate portion without contact therewith.

7. The electrical track and connector assembly of claim 3, wherein said two connecting end portions of said housing are spaced apart from each other and extend substantially parallel to each other, each of said first and second intermediate portions having said first bent rising section, said first bent rising section of said first intermediate portion being held by said wire prop-up unit and extending across said ground intermediate portion without contact therewith, said first bent rising section of said second intermediate portion being held by said wire prop-up unit and extending across said first intermediate portion and said ground intermediate portion without contact therewith.

8. The electrical track and connector assembly of claim 3, which comprises four said electrical tracks, wherein said housing has four said connecting end portions extending in four different directions, each of said first, second, and ground intermediate portions having four interconnected wires, two of said interconnected wires of said first intermediate portion each having said first bent rising section held by said wire prop-up unit and extending across one of said interconnected wires of said second intermediate portion and one of said interconnected wires of said ground intermediate portion, two of said interconnected wires of said second intermediate portion each having said first bent rising section held by said wire prop-up unit and extending across another one of said interconnected wires of said ground intermediate portion.

9. The electrical track and connector assembly of claim 3, which comprises four said electrical tracks, wherein said housing has four said connecting end portions extending in four different directions, each of said first, second, and ground intermediate portions having four interconnected wires, one of said interconnected wires of said first intermediate portion having said first bent rising section held by said wire prop-up unit and extending across one of said interconnected wires of said second intermediate portion and one of said interconnected wires of said ground intermediate portion, one of said interconnected wires of said second intermediate portion having said first bent rising section held by said wire prop-up unit and extending across another one of said interconnected wires of said ground intermediate portion, two of said interconnected wires of said ground intermediate portion each having a second bent rising section held by said wire prop-up unit and extending across another one of said interconnected wires of said first or second intermediate portion.

10. An electrical track and connector assembly comprising:

at least two electrical tracks, each of which includes first and second track wires spaced apart from each other; and an electrical connector including a housing having at least two connecting end portions connected respectively to said electrical tracks, and a wire prop-up unit that includes a block projecting from an inner surface of said housing, and first and second conductive wire units disposed in said housing, said first conductive wire unit including at least two first terminals respectively disposed in said connecting end portions and connected electrically and respectively to said first track wires of said electrical tracks, and a first intermediate portion interconnecting said first terminals, said second conductive wire unit including at least two second terminals respectively disposed in said connecting end portions and connected electrically and respectively to said second track wires of said electrical tracks, and a second intermediate portion interconnecting said second terminals, at least one of said first and second intermediate portions having at least one bent rising section held by said wire prop-up unit, said block having an indentation disposed away from said inner surface of said housing to retain therein said bent rising section of said one of said first and second intermediate portions.

* * * * *